US011779141B2

(12) United States Patent
Hackett

(10) Patent No.: US 11,779,141 B2
(45) Date of Patent: Oct. 10, 2023

(54) GOLF-THEMED DEVICE FOR CONSUMING A BEVERAGE

(71) Applicant: David Joseph Hackett, Orlando, FL (US)

(72) Inventor: David Joseph Hackett, Orlando, FL (US)

( * ) Notice: Subject to any disclaimer, the term of this patent is extended or adjusted under 35 U.S.C. 154(b) by 48 days.

(21) Appl. No.: 17/445,441

(22) Filed: Aug. 19, 2021

(65) Prior Publication Data

US 2022/0061568 A1 Mar. 3, 2022

Related U.S. Application Data

(60) Provisional application No. 63/072,446, filed on Aug. 31, 2020.

(51) Int. Cl.
*A47G 23/02* (2006.01)
*A47G 19/22* (2006.01)

(52) U.S. Cl.
CPC ..... *A47G 23/0225* (2013.01); *A47G 19/2227* (2013.01); *A47G 19/2261* (2013.01); *A47G 2200/106* (2013.01); *A63B 2225/682* (2013.01)

(58) Field of Classification Search
CPC ..... A47G 23/02; A47G 23/0208; A47G 23/0216; A47G 23/0225; A47G 19/2261; A47G 19/2255; A47G 19/2227; A47G 19/2205; A63B 2225/682; A63F 2009/0058; A63F 7/0628; A63F 9/00
See application file for complete search history.

(56) References Cited

U.S. PATENT DOCUMENTS 2,639,804 A 5/1953 Merahn
D313,534 S * 1/1991 Stadtmueller ..... D7/506
D370,829 S * 6/1996 Neale ..... D7/533
5,899,511 A 5/1999 Dinatale
6,346,051 B1 2/2002 Otsubo
6,962,536 B2 11/2005 Hall et al.
7,153,218 B1 12/2006 Elkin
7,854,664 B1 12/2010 Comrie
8,733,578 B2 5/2014 Michaels
9,119,490 B1 9/2015 Parodi, Jr.
D781,105 S * 3/2017 Wolff ..... D7/301
2002/0153344 A1 10/2002 Pola et al.
2006/0180254 A1 8/2006 Morley et al.
2008/0261714 A1 10/2008 Bae
2010/0224642 A1* 9/2010 Beeson ..... A47G 23/08 248/346.03
2014/0135142 A1 5/2014 David, Sr.
2017/0157481 A1 6/2017 Sessa
2018/0141716 A1 5/2018 Trenchfield et al.
2019/0193891 A1 6/2019 Livesley-James et al.

OTHER PUBLICATIONS

NPL Kuuk; Kuuk Magnetic Shatterproof Outdoor Wine Glass;Nov. 16, 2015; https://www.amazon.com/Kuuk-Magnetic-Shatterproof-Outdoor-Glass/dp/B00S6HMPHA/?tag=cnet-buy-button-20&ascsubtag=3192ffc4-f630-4a7b-aa80-0b2a44acb02b%7C76beae1a-ca3e-401e-b205-0672029f0a3e%7Cdtp%7Ccn (Year: 2015).*

* cited by examiner

*Primary Examiner* — Javier A Pagan

(74) *Attorney, Agent, or Firm* — Dunlap Bennett & Ludwig, PLLC

(57) ABSTRACT

A device, method, and system for consuming a beverage is disclosed herein. The device includes a golf club, a tee coupled to a club head of the golf club, and a shot glass coupled to the tee. In use, a user pours the beverage into the shot glass, lifts the golf club and the shot glass connected thereto, and consumes the beverage from the shot glass.

9 Claims, 4 Drawing Sheets

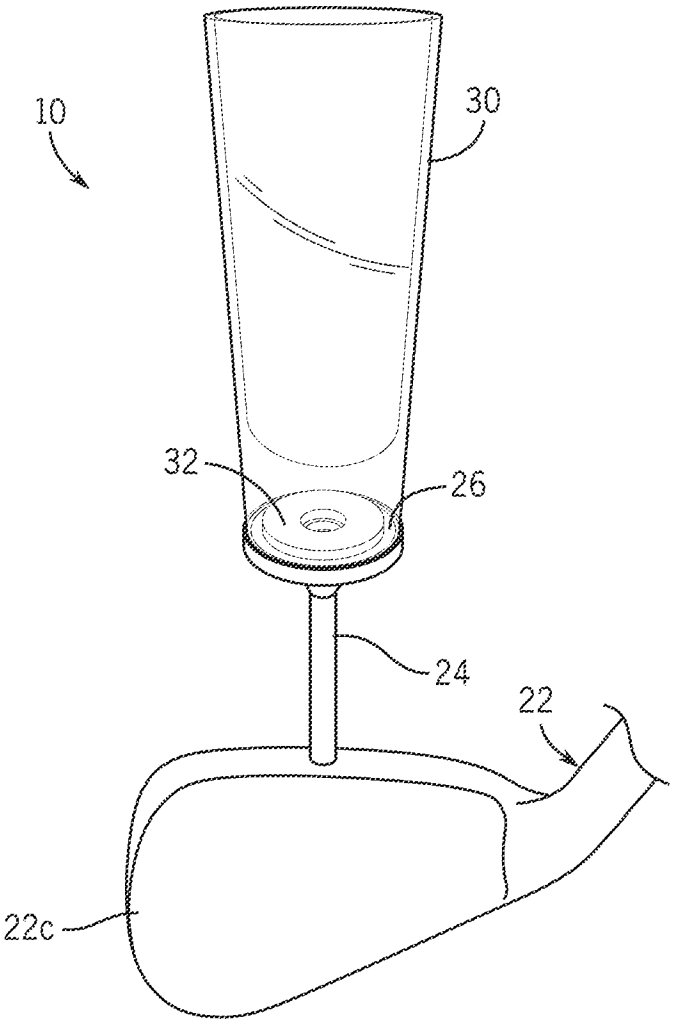
FIG. 4
FIG. 3
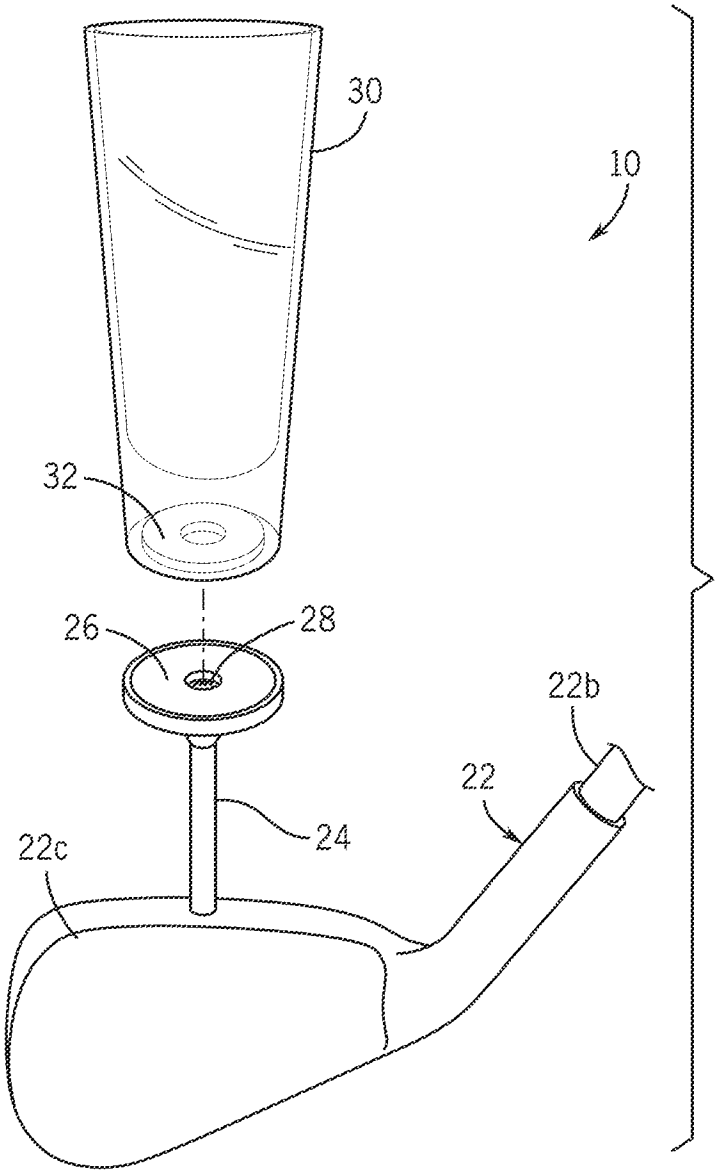

GOLF-THEMED DEVICE FOR CONSUMING A BEVERAGE

CROSS-REFERENCE TO RELATED APPLICATION

This application claims the benefit of priority of U.S. provisional application No. 63/072,446, filed Aug. 31, 2020, the contents of which are herein incorporated by reference.

BACKGROUND OF THE INVENTION

The present invention relates to a novel way to consume alcohol and, more particularly, to a golf club provided with a magnetic tee shot glass.

Consumption of alcohol, in particular, with shot glasses is old and well-known. However, there have been few innovations over the years to improve, excite or make the experience of a shot more unique. In the vast majority of cases, a user simply picks up the shot glass and consumes their alcohol of choice.

Alcohol is often consumed in group settings (such as, but limited to, parties and other types of gatherings), and, thus, a social element is inherently linked to the consumption thereof at these types of gatherings. New, exciting experiences serve to increase the entertainment factor at such a gathering. The conventional ways to consume alcohol fail to enhance that experience. They are simply a conduit for drinking the alcohol, and do not add anything of value beyond that.

As can be seen, there is a need for a novel way to consume a shooter/shot of alcohol.

SUMMARY OF THE INVENTION

In one aspect of the present invention, a device for consuming a beverage comprises: a golf club comprising a shaft and a club head; a tee comprising a first end and a second end, the first end coupled to the club head and the second end having a first coupling element secured thereto; and a shot glass having a second coupling element connected to a bottom side thereof, the shot glass being configured to connect to the second end of the tee.

In another aspect of the present invention, a method for consuming a beverage comprises the steps of: providing a golf club comprising a shaft and a club head; providing a tee comprising a first end and a second end, the first end coupled to the club head and the second end having a first coupling element secured thereto; providing a shot glass having a second coupling element connected to a bottom side thereof; connecting the shot glass to the second end of the tee; pouring the beverage into the shot glass; grasping the shaft of the golf club; lifting the golf club and the shot glass connected thereto; and consuming at least a portion of the beverage.

These and other features, aspects and advantages of the present invention will become better understood with reference to the following drawings, description, and claims.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

FIG. 3 is an exploded detail perspective view of the embodiment of the present invention;

FIG. 4 is a detail perspective view of the embodiment of the present invention, similar to FIG. 3, showing a shot glass attached to a golf club;

DETAILED DESCRIPTION OF THE INVENTION

Figure 1:
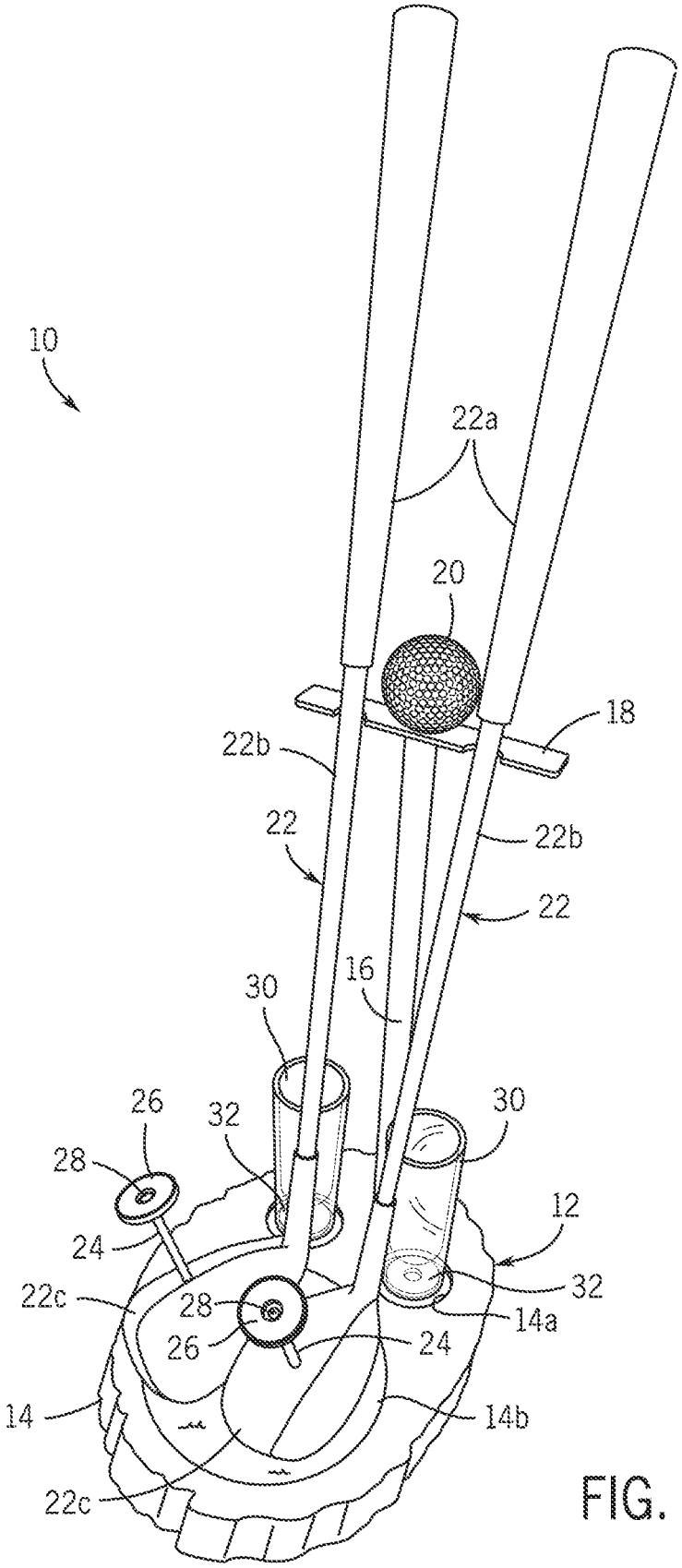
FIG. 1 is a perspective view of an embodiment of the present invention.

The subject disclosure is described with reference to the drawings, wherein like reference numerals are used to refer to like elements throughout. In the following description, for purposes of explanation, numerous specific details are set forth in order to provide a thorough understanding of the present disclosure such that one skilled in the art will be enabled to make and use the present invention. It may be evident, however, that the present disclosure may be practiced without some of these specific details.

Broadly, an embodiment of the present invention provides a device for consuming a beverage in a novel way. The device includes a golf club including a shaft and a club head, with a hole being formed on an upper side of the club head. A tee is secured within the hole and projects out of the hole. An end of the tee includes one of a ferromagnetic material and a magnetic material connected to the end. Further a shot glass is provided that has the other of the ferromagnetic material and the magnetic material connected to a bottom side thereof. The shot glass is design to detachably sit on the end of the tee via attractive forces between the ferromagnetic material and the magnetic material.

Embodiments of the present invention are a fun, unique, different, and exciting way to do a shot of alcohol, such as liquor. All elements herein described, unless otherwise noted, are needed for the present invention to work as intended. However, it will be appreciated that variants of structure employed, such as types of golf clubs (e.g., a driver, wood, iron, wedge, putter, and the like), ways of attaching parts together, etc. are envisioned and in accordance with the present invention.

Figure 6:
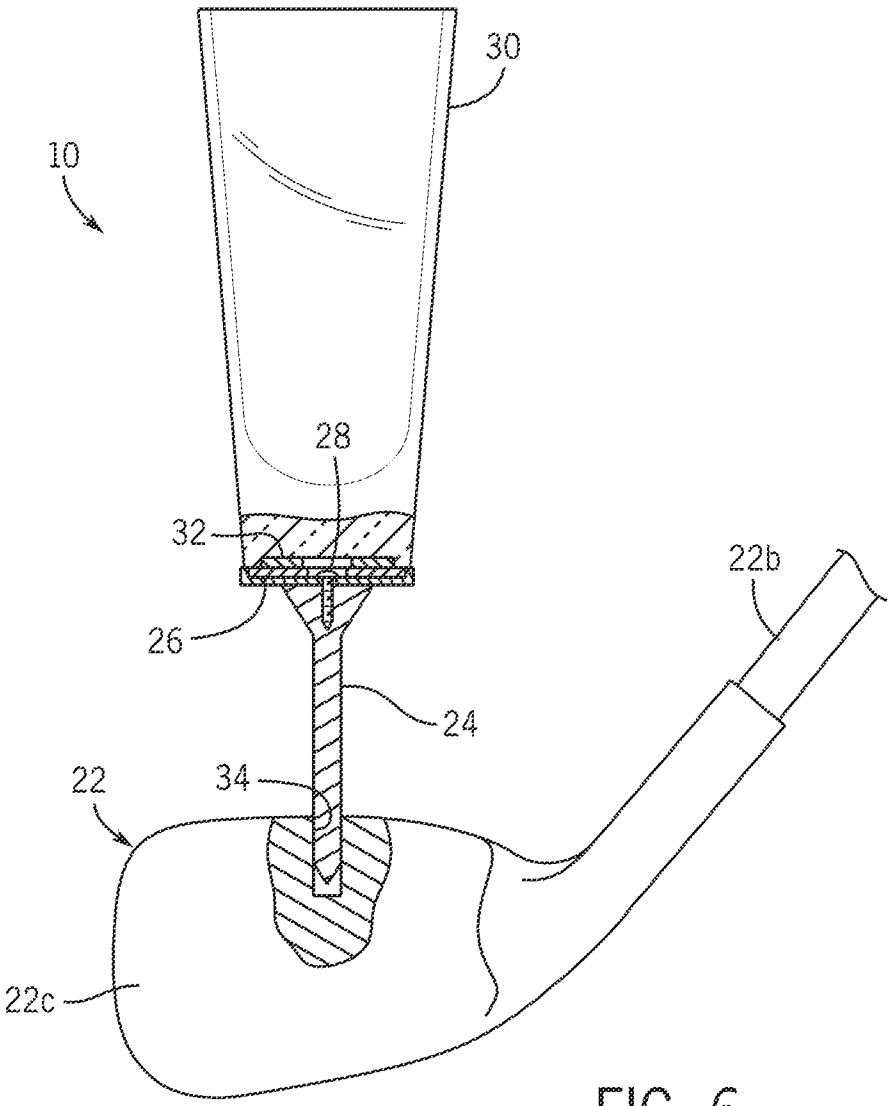
FIG. 6 is a side detail elevation view of the embodiment of the present invention, with parts broken away for clarity.

Referring now to FIGS. 1-6, a golf club and shot glass system 10 comprises one or more shortened golf clubs 22 that are configured for consuming a shot provided in a shot glass 30. It will be appreciated by those with skill in the art that, while the term "shot glass" is used, the shot glass 30 does not necessarily need to be made from glass (the shot glass 30 could be formed out of plastic, for example). The one or more golf clubs 22 each include a club head 22*c*, a shortened shaft 22*b*, and optionally, a club grip 22*a*. The club head 22*c* may define a hole 34 in a top surface thereof, as shown in FIG. 6.

The shortened shaft 22*b* may be, in certain embodiments, between approximately 21-25 inches in length. While other shaft lengths are envisioned and within the scope of the present invention, the presently disclosed range has been found to be ideal in terms of being adequately sized to couple the grip 22*a* and to permit users within a normal height range to be able to consume the shot as intended. As used herein, the term "shortened shaft" refers to club/shaft lengths less than 25 inches.

In certain embodiments, the grip 22*a* can indicate the level of difficulty of the shot by placing a red dot or ring at the bottom of the grip, a white ring or dot in the center, blue dot or ring at the top, and the like. The closer the user's hand grasping the grip 22*a* is to the shot glass 30, the less challenging the shot will be to do.

One or more tees 24, made from a material such as wood, plastic, or the like, are each provided with magnet 26 attached to a top portion of the tee 24 via, for example, a fastener 28 or other appropriate means. It will be appreciated that, while the term "tee" is used to generally describe the structure that the magnet 26 connect to, other slender, elongated structures resembling the shape of a tee may be used in accordance with the present invention. By way of example, and in certain embodiments, the tee 24 may be approximately 2.25 inches, but may be formed with any appropriate height, and the magnet 26 may have, for example, approximately a 1-inch diameter. The tee 24 is secured, such as by gluing and/or any other appropriate means, within the hole 34 defined in the head 22*c* of each golf club 22.

Figure 5:
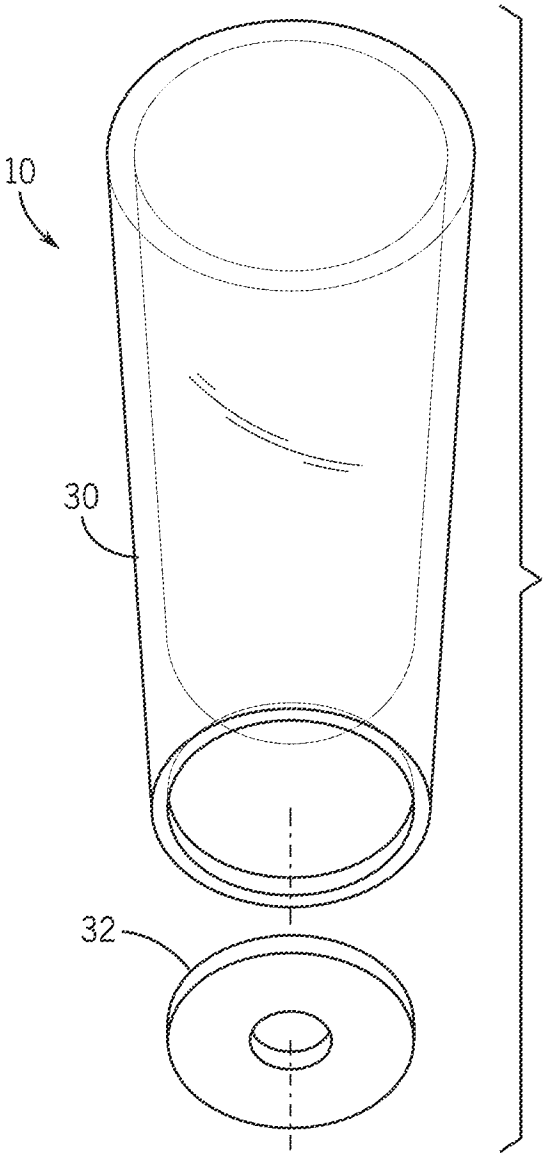
FIG. 5 is a bottom exploded detail perspective view of the embodiment of the present invention, showing the shot glass and a ferromagnetic material.

A shot glass 30 (such as, but not limited to, a 4.25-inch-tall glass) is provided with a ferromagnetic material 32 attached to its bottom, as shown for example, in FIGS. 4-6. Those with skill in the art will appreciate that the magnet/ferromagnetic material configuration may easily be reversed such that the magnet 26 is provided on the shot glass 30 and the ferromagnetic material 32 is provided on the tee 24. While the shot glass 30 could also be permanently fixed to the tee 24, providing it as detachable ensures that it is easier to clean or replace, as needed.

Figure 2:
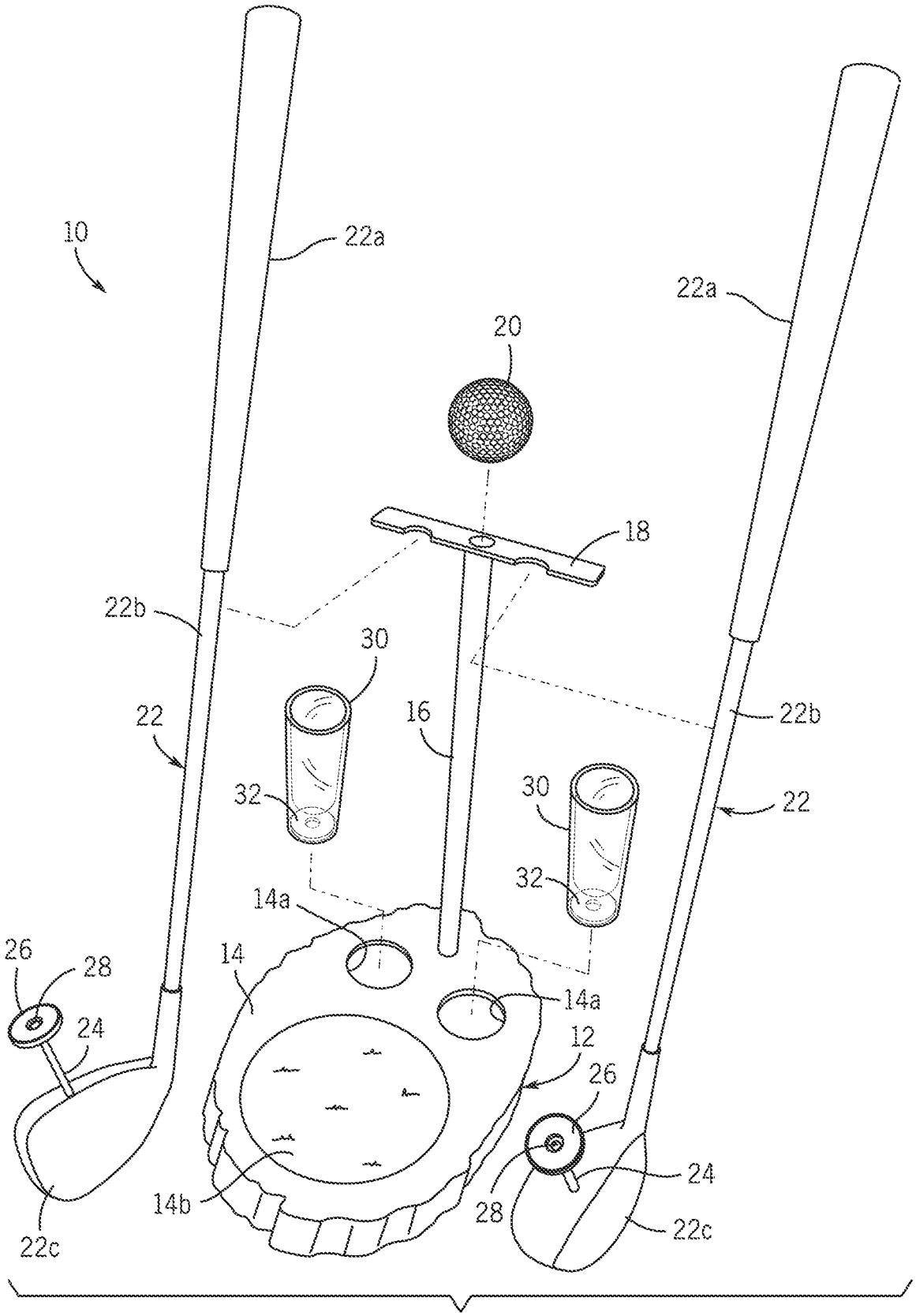
FIG. 2 is an exploded perspective view of the embodiment of the present invention.

Making further reference to FIG. 1, prior to use, the one or more golf clubs 22 may be supported by a stand 12 having a base 14, an upright support 16, a club holder 18 for supporting the one or more club shafts 22*b* in place, and an ornamental themed element 20 (such as a golf ball). As shown in FIGS. 1-2, the base 14 may include one or more recessed portions, that serve as glass holders 14*a*, and a section of turf 14*b* for the one or more club heads 22*c* to rest on, with the turf 14*b* functioning as a frictional and decorative surface.

In use, a shot may be served on the stand 12 by placing the shot glass 30 on the tee 24 prior to doing the shot and filling up the shot glass 30 with a user's alcohol (or other consumable liquid) of choice. The shot glass 30 may also be filled while it sits within of the glass holders 14*a* and then placed on the tee 24 (e.g., FIG. 4). Finally, the grip 22*a* may be grasped by the user to lift the golf club 22 with shot glass 30, and the user may proceed to attempt to consume the shot without spilling on themselves.

The shortened club 22 creates a challenge when doing the shot. Specifically, because a user must keep the shot glass 30 balanced while grasping the grip 22*a*, the complexity of consuming the shot is increased (users must be focused and coordinated with their movements), creating a more entertaining experience (both for the user and those that may be observing the user). The tee 24 with integrated magnet 26 helps to maintain the shot glass 30 filled with a liquid (such as alcohol/liquor) to stay in place while doing the shot, while also introducing the possibility of it being knocked off the tee 24 if the user does not consume the shot with sufficient control.

Various methods of making embodiments of the present invention would be apparent to those with skill in the art from the foregoing description, and a further method is detailed as follows. A used or new golf club 22 may acquired, with the shaft 22*b* being shortened by cutting it to approximately 20 inches. Alternatively, a shortened golf club 22 may be manufactured, using conventional techniques, with the exception being that the shaft 22*b* be formed such that it is approximately 20-22 inches (rather than conventional longer lengths). A grip 22*a*, such as a junior grip, is connected to a top end of the end of the club shaft 22*b*. A hole 34 is formed (such as by drilling with a drill bit, for example, ⅛ inch or 9/16 inch in diameter) in the head 22*c* of the club 22, about ¾-inch-deep, for example. The hole 34 may be formed on the top or face of the head 22*c*, depending upon how the club 22 naturally sits (to ensure the shot glass 30 sits at least partially level). The tee 24 may then be inserted into the hole 34 and secured in place. The magnet 26 is next attached to the top of the tee 24. The magnet 26, in certain embodiments, may be an 8-pound stainless cupped magnet. A ferromagnetic material 32, such as a metal washer, is secured (such as via an adhesive) to the bottom of a shot glass 30. The shot glass 30 may be provided in various sizes, such as, but not limited to, 1.5 ounces and 2 ounces. Once any materials, such as glue or a resin, that are used to attach various parts together have set, the shortened golf club 22 with connected shot glass 30 is ready for use.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein.

While apparatuses and methods are described in terms of "comprising," "containing," or "including" various components or steps, the apparatuses and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values.

Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

Moreover, the use of directional terms such as above, below, upper, lower, upward, downward, left, right, and the like are used in relation to the illustrative embodiments as they are depicted in the figures, the upward or upper direction being toward the top of the corresponding figure and the downward or lower direction being toward the bottom of the corresponding figure.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A device for consuming a beverage, the device comprising:

a golf club comprising a shaft and a club head;

a tee comprising a first end and a second end, the first end coupled to the club head and the second end having a first coupling element secured thereto, wherein the club head defines a hole on an upper portion thereof, and the first end is coupled to the club head within the hole;

a shot glass having a second coupling element connected to a bottom side thereof, the shot glass being configured to connect to the second end of the tee.

2. The device of claim 1, wherein the tee extends substantially upwardly from the club head.

3. The device of claim 1, wherein the shot glass detachably connects to the second end of the tee.

4. The device of claim 1, wherein the shaft is a shortened shaft.

5. The device of claim 4, wherein the shortened shaft comprises a length between 20 to 22 inches.

6. The device of claim 1, wherein the first coupling element comprises one of a magnetic material and a ferromagnetic material and the second coupling element comprises the other of the magnet and the ferromagnetic material.

7. The device of claim 1, further comprising a grip provided at an upper portion of the shaft and configured to be grasped.

8. The device of claim 1, wherein the golf club is selected from the group consisting of: a driver, an iron, a wedge, and a putter.

9. A method for consuming a beverage, the method comprising the steps of:

providing a golf club comprising a shaft and a club head;

providing a tee comprising a first end and a second end, the first end coupled to the club head and the second end having a first coupling element secured thereto, wherein the club head defines a hole on an upper portion thereof, and the first end is coupled to the club head within the hole;

providing a shot glass having a second coupling element connected to a bottom side thereof;

connecting the shot glass to the second end of the tee;

pouring the beverage into the shot glass;

grasping the shaft of the golf club;

lifting the golf club and the shot glass connected thereto; and consuming at least a portion of the beverage.

* * * * *